United States Patent [19]

Balta et al.

[11] 4,348,122

[45] Sep. 7, 1982

[54] SHIFT LOCK AND POSITION INDICATING TORSION SPRING ACTIVATED KEY SWITCH

[76] Inventors: Justin O. Balta, 5638 Atlle, Jacksonville, Fla. 33205; Edward I. Nelson, 10430 NW. 24th St., Sunrise, Fla. 33322

[21] Appl. No.: 200,254

[22] Filed: Oct. 23, 1980

[51] Int. Cl.[3] ..... B41J 5/20

[52] U.S. Cl. ..... 400/276; 400/477; 200/153 J; 340/365 P

[58] Field of Search ..... 400/274, 276, 276.2, 400/477, 479, 253, 272, 478, 495; 200/153 J, 67 C, 340; 340/365 P

[56] References Cited

U.S. PATENT DOCUMENTS

| | | | |
|---|---|---|---|
| 3,235,741 | 2/1966 | Plaisance | 340/365 P |
| 3,288,973 | 11/1966 | Piber | 200/153 J X |
| 3,375,340 | 3/1968 | Wright | 200/153 J |
| 3,542,988 | 11/1970 | Baldsare | 200/153 J X |
| 3,818,485 | 6/1974 | Harrison et al. | 340/365 P |
| 3,824,362 | 7/1974 | Bury | 200/153 J |
| 4,112,277 | 9/1978 | Kleeb | 200/153 J |
| 4,188,136 | 2/1980 | Bedocs | 400/276 |

*Primary Examiner*—Edgar S. Burr
*Assistant Examiner*—Charles A. Pearson
*Attorney, Agent, or Firm*—Carl Fissell, Jr.; Kevin R. Peterson; David G. Rasmussen

[57] ABSTRACT

This invention relates to a novel shift lock actuation mechanism useful, for example, in keyboard apparatus wherein a key stem supporting a key is shaped to mate with apertures in the keyboard supporting arrangements or as individual switches and as such contains oppositely disposed, inwardly deformable, flanged members for captivating the key stem within the key apertures and further includes a shift lock cam operably associated with a single turn C-shaped torsion spring member, one end of the C-shaped spring engaging key stem while the opposite end of the C-shaped spring is captivated by the cam, effective upon movement of the key stem to move the cam into one or the other of two positions effective to lock the key stem in a desired position so as to block or unblock light from light emitter-receptor apparatus indicating the position of the key.

7 Claims, 15 Drawing Figures

SHIFT LOCK AND POSITION INDICATING TORSION SPRING ACTIVATED KEY SWITCH

BACKGROUND OF THE INVENTION

1. Field of the Invention

The invention relates to actuating mechanisms such for example as those devices used for key switches and to key switches which are utilized with reconfigurable keyboards. With still more specificity the invention relates to a key switch for a reconfigurable photo optical keyboard having a novel shift lock mechanism utilizing a C-shaped single turn torsion spring.

2. Description of the Prior Art

Prior art keyboard key switches generally utilize coiled springs one end of which (generally the bottom end of the spring) is secured to a base support member while the opposite end is secured to a movable portion of the key switch. This construction requires an upper and a lower attachment as well as some means to retain the key stem from falling out of the bottom of the base structure assembly. Usually this structure is the bottom or baseboard of a keyboard. Replacement rearrangement or service of this type of key and keyboard arrangement requires special tools and is time consuming and inefficient. Also, key switches of the prior art are generally relatively complicated in their construction and those that have shift lock elements are fairly complex in their structural elements and require relatively large amount of tooling to fabricate and to insert into the keyboard, often requiring considerable hand work.

Other keyboard systems of the prior art produce wear characteristics which are highly undesirable both with respect to the shift lock mechanism as well as with respect to the key depression itself. And, importantly, prior art designs require separate switch bodies and individual structural combinations for utilizing a specifically designed key shift lock which increases the cost and complexity of assembly and tend to decrease efficiency by increasing the risk of failure due to increase in the number of parts and wear surfaces.

This application is related to application U.S. Ser. No. 124,945, now U.S. Pat. No. 4,301,345 filed Feb. 26, 1980 in the name of Justin O. Balta, Entitled "Key Switch Actuation By Torsion Spring" and assigned to the present assignee.

SUMMARY OF THE INVENTION

The present invention provides a new, novel and heretofore unknown demountable, replaceable key switch and associated shift lock mechanism for use with a keyboard having key switch apertures for demountably retaining individual keys therein. The key switch shift lock actuation mechanism of the present invention comprises a key stem mounted for reciprocable movement relative to a fixed mounting member such as a keyboard and a single turn C-shaped torsion spring one end of which engages an insert member while the opposite end of the spring is seated within and movable over a plurality of cam surfaces within its operably associated shift lock cam demountably receivable within a receiving area in the key stem.

The key stem is press fitted into an insert member which is likewise seated within an aperture in the housing of the keyboard structure. A coupler support pluggably engageable with a "PC board" and with the insert provides means for supporting and orienting a light emitter and a light detector oppositely disposed and in confronting relationship with respect to one another. A depending, integral tab or tang on the lower portion of the key stem is provided with an aperture therethrough such that depression of the key stem causes light from the emitter to be unblocked to the detector while release of the key stem moves the tang or tab into a light blocking position. The shift lock mechanism enables the key to be maintained in either a light blocking or unblocking position with a respective signal or no signal output indication.

It is an important object therefore of the present invention to provide a demountable key switch shift lock actuation mechanism for insertion within the key stem without the requirement for special insertion tooling.

Another important object of the present invention is the provision of a key switch shift lock mechanism including a spring biasing member which can be inserted into a standard profile key stem without change in key stem geometry.

Another important object and feature of the present invention is the provision of a single key stem construction which provides means for employing a key shift lock mechanism as desired but which does not require the shift lock mechanism where such is not required.

Other objects, features and advantages of the present invention will be readily apparent in the following detailed description when considered in light of the accompanying drawings, which illustrate by way of example, and not limitation, the principles of the invention and preferred modes for applying those principles.

BRIEF DESCRIPTION OF THE PREFERRED EMBODIMENT

Figure 1:
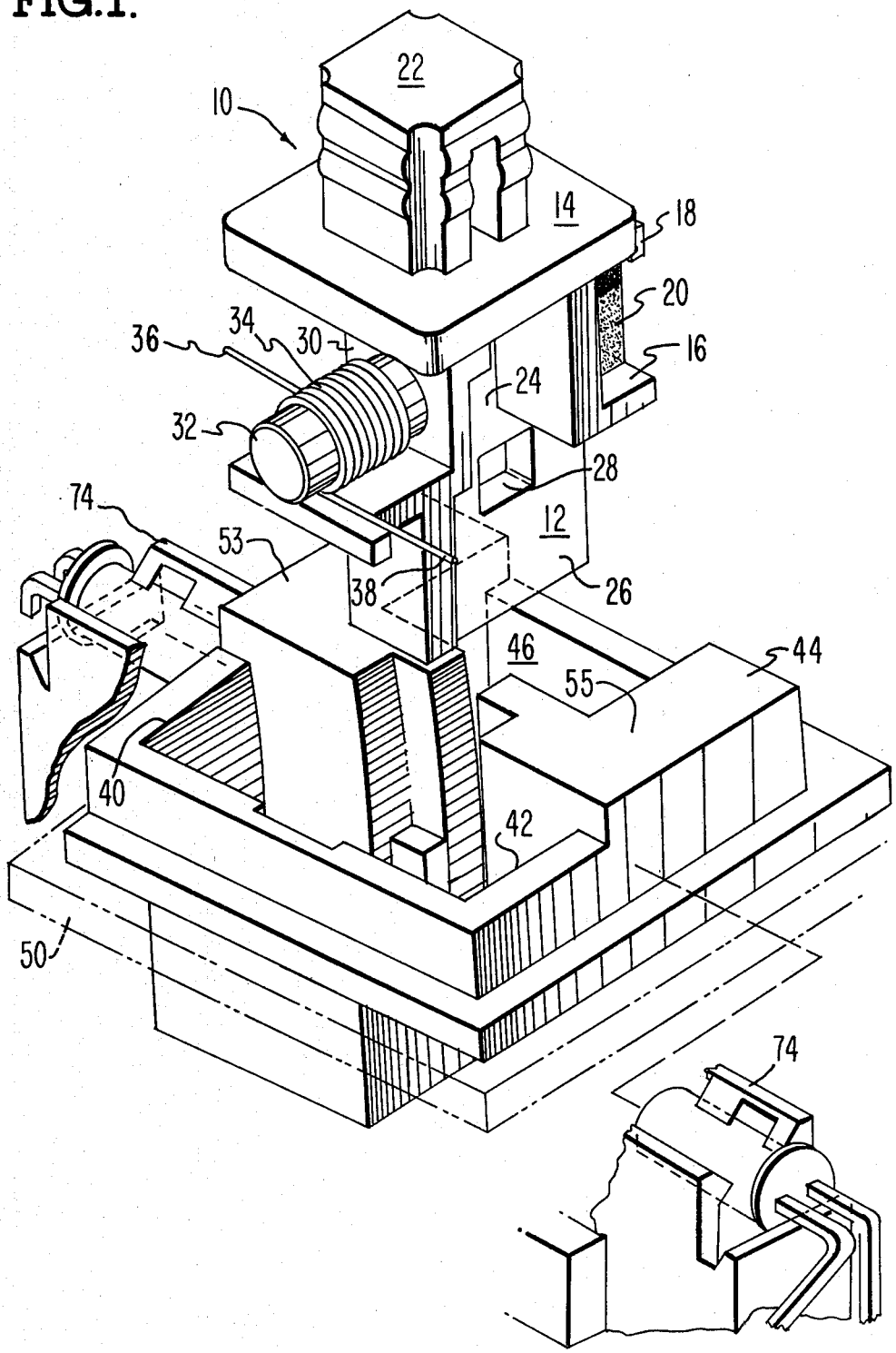
FIG. 1 is a greatly enlarged highly idealized, schematic, isometric view of the shift lock key switch actuation mechanism of the present invention as incorporated in a photo optical keyboard assembly.

With reference to the drawings, it is seen, that the present invention is illustrated in the environment of a keyboard wherein a plurality of vertically, reciprocably movable keys are arranged in a pattern of rows and columns (only a portion of a single row being illustrated in the drawing). However, it is noted that the actuation mechanism as herein described in and of itself is useful in a variety of structural permutations and accommodations quite apart from keyboards per se.

Figure 5:
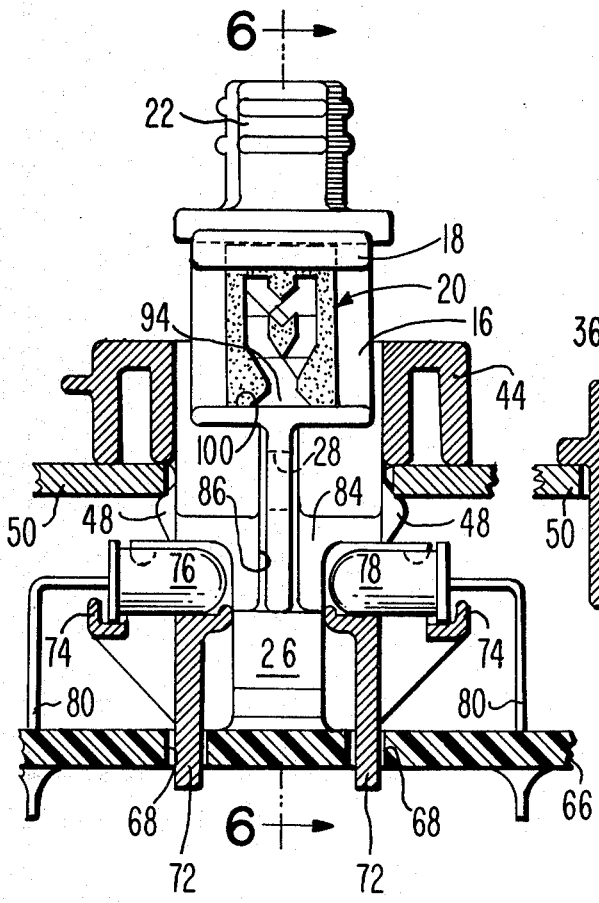
FIG. 5 is a front view partially in section of the shift lock actuation mechanism of the present invention.
Figure 6:
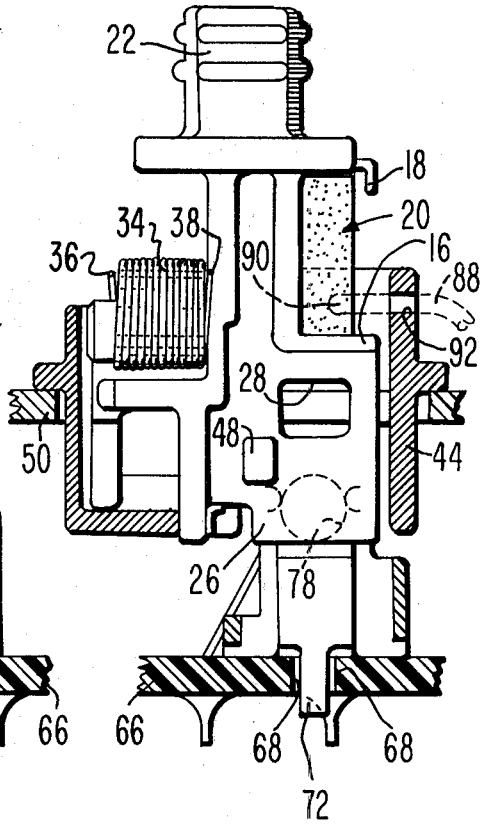
FIG. 6 is a side elevational view along the line 6—6 of FIG. 5 of the apparatus embodying the present invention.

As seen most clearly in the greatly enlarged, illustrative, schematic, isometric view of FIG. 1 of the drawings, the actuation mechanism 10 of the present invention, comprises a key stem assembly 12 which may be substantially rectangular in external configuration having a flat plate member 14 intermediate the top with a depending rear L-shaped receiver 16 provided with an overhanging lip 18. This structural arrangement provides a receptacle, as seen in FIGS. 5 and 6, for a dimountable, insertable, removable shift lock cam member 20, as will be discussed in detail later on herein. The top of key stem 12 is formed as a vertically disposed free standing projection 22 integral with stem 12. The opposite left and right vertical side wall portions (only the right hand portion 24 being visible) open inwardly to form a depending tab or tang 26 which is provided with a central rectangular aperture or opening 28 as seen in FIG. 1, for purposes to be explained shortly.

Integral with and projecting outwardly from the forwardly facing solid wall 30 of stem 12 is a post, stud or pivot member 32. Member 32 acts as a rotative mounting support or pivot for a prewound and pretensioned torsion spring 34, as shown. The initial coiling direction of spring 34 permits the spring to be used in a winding or an unwinding direction as desired.

Spring member 34 is seated on pivot member 32 so as to be freely rotatable arcuately thereabout. The left and right opposite ends 36 and 38, respectively, of spring 34 are adapted to extend outwardly away from the center thereof and initially to rest against the internal oppositely disposed left and right edges 40 and 42 of insert member 44 as seen most clearly in FIGS. 2 and 3 of the drawings.

Figure 3:
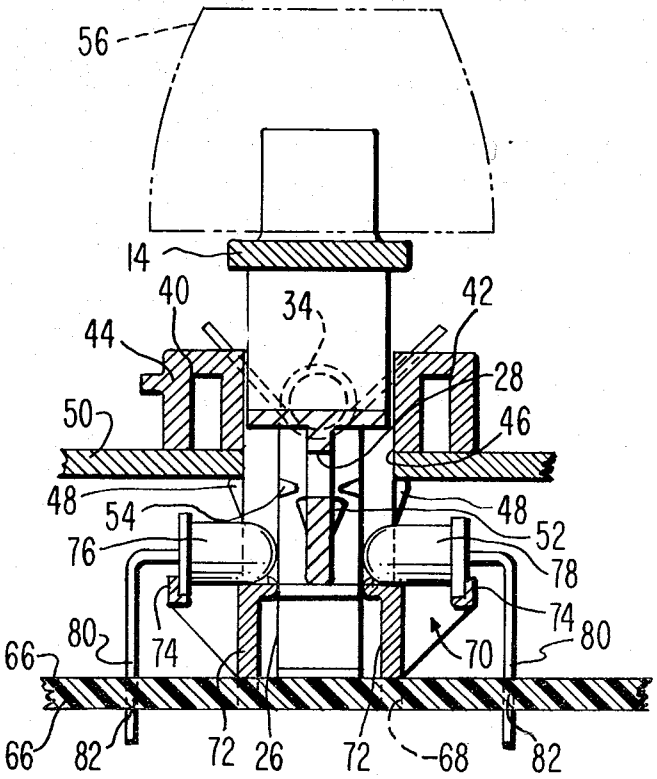
FIG. 3 is a view similar to FIG. 2 illustrating the key switch in the nonenergized or "undepressed" position.
Figure 2:
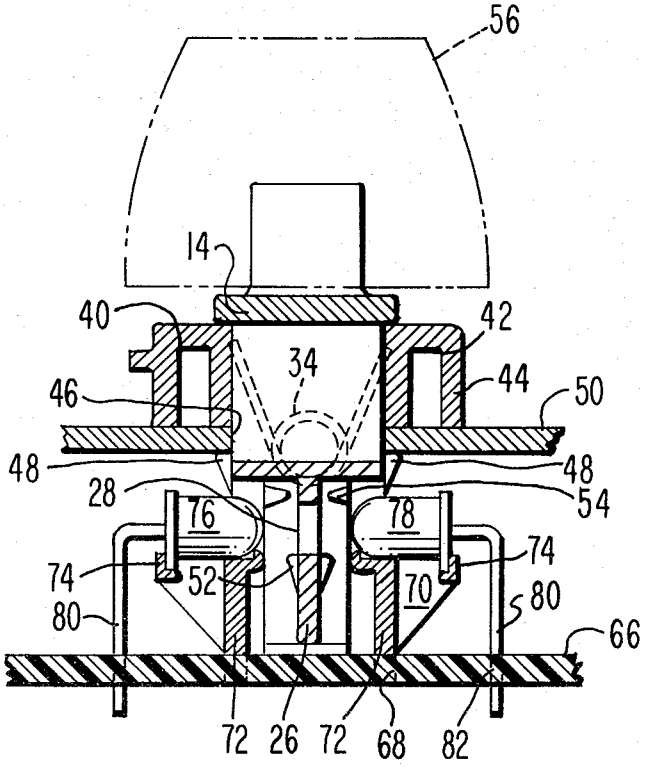
FIG. 2 is a side elevational view of the apparatus of the present invention illustrating the key switch in the energized or "depressed" condition.

As seen in FIG. 1, the insert member 44 is provided with an irregularly shaped internal opening 46 extending completely therethrough for slidably receiving the key stem assembly 12. Insert member 44, as seen in FIGS. 2 and 3 includes oppositely disposed flexible projections or ears 48. Members 48 provide retaining means for insert member 44 when member 44 is fully inserted as by press fitting within the substantially rectangular aperture opening 46, FIG. 2, 3 and 6, in the supporting keyboard structure 50 with which the present device may be operably incorporated.

Figure 4:
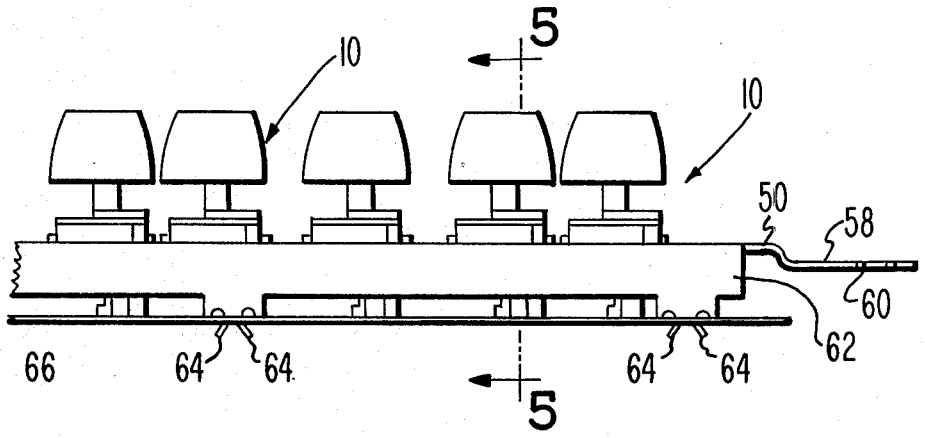
FIG. 4 is a front elevational view of the portion of the keyboard structure embodying the present invention.

Key stem assembly 12, as seen most clearly in FIGS. 2 and 3 of the drawings, includes oppositely disposed outwardly projecting tabs or ears 52 integral therewith and disposed adjacent to and below the light opening 28. As key stem assembly 12 is inserted into insert 44 members 52 engage and pass between the retainer projections 54 extending inwardly from the lower portion of the central opening 46 in the insert member 44. Members 54 thus prevent accidental dislodgement or removal of key stem assembly 12 while simultaneously acting as vertical stop means for the upward travel of key stem 12. Downward travel is limited by means of the flat plate 14 as the lower portion thereof abutts the shoulder portions or surfaces 53 and 55 of insert member 44. The edge or rim portions 40 and 42 may be slightly canted or chamferred so as to slidably receive the coiled spring ends 36 and 38. Although not shown in the idealized view of FIG. 1, but shown in dotted outline in FIGS. 2, 3 and 4 a key top 56 is press fitted over the square vertically projecting member 22 to indicate the specific alpha numeric datam desired or employed.

A feature of the present invention is the provision of a rigid, sheet metal frame 50 in place of the more conventional and well known molded keyboard base or support. As seen most clearly in FIG. 4 a thin, flat sheet of rigid material e.g. sheet metal, is or may be punched, stamped or cut so as to provide a plurality of rows and columns of substantially rectangular apertures or openings (not shown) providing receptacles for individual actuation mechanisms such as the key switch assemblies 10 shown. It is noted that each opposite end of the rectangular metal frame is provided with a mounting flange 58 having mounting hole 60 therein for attaching the frame into a suitable support or housing (not shown). Opposite front and rear edge portions of frame 50 are bent downwardly at right angles to the main plain of member 50 forming a longitudinally extending rigidifying lip 62 and each bent over edge 62 includes pairs of staked out "spread tabs" 64 for purposes to be described shortly.

Disposed beneath the lower surface of member 50 and spaced therefrom by a slight but uniform distance is a flat rectangular printed circuit board 66 bearing interconnected circuit wiring (not shown) employed with the key switch apparatus with which the present invention is utilized.

Press fitted into preformed or drilled apertures or opening 68 (seen most clearly in FIGS. 5 and 6 but also in dotted outline in FIGS. 2 and 3) is a coupler support member 70. Oppositely disposed, parallel depending leg members 72 of each support member 70 project into and through a respective pair of apertures 68. The upper, irregularly shaped surface of member 70 forms a pair of oppositely disposed rigid "snap in" supports 74 for confronting light generator-emitter and light collector detector members 76 and 78, respectively. The pigtail leads 80 for each light processing member 76 and 78 are bent downwardly and project into and through plated through holes 82 (FIGS. 2 and 3) in PC board 66, into which they are or may be soldered connected as seen in FIGS. 5 and 6.

The lower central portion 84 of insert member 44 provides a vertical, enlogated guideway 86 for the relatively thin, flat, depending tang or tab 26 for vertical "up and down" movement of this member so as to bring the aperture 28 therein into position to unblock the light from emitter 76 to detector 78 as the key stem is moved from the light blocking position of FIG. 3 to the light unblocking position of FIG. 2. As seen most clearly in FIG. 4 the PC board 66 is joined to the key switch mechanism by means of the spread tabs 64—64, each pair of which are bowed outwardly from one another once inserted through the board so as to securely attach the mounting member 50 supporting the key switch actuation mechanism to the PC board 66.

The present invention contemplates a novel key switch locking mechanism for those switching combinations or apparatus wherein it is necessary or desirable to hold the key in either an "on" or an "off" position or condition. Similar in function to the shift lock assembly for a conventional typewriter permitting the device to shift from lower to upper case printing and back and lock. Means is provided for locking the key switch in its depressed "on" position. Or, returning it to its released "off" position upon a second key depression.

Figure 12:
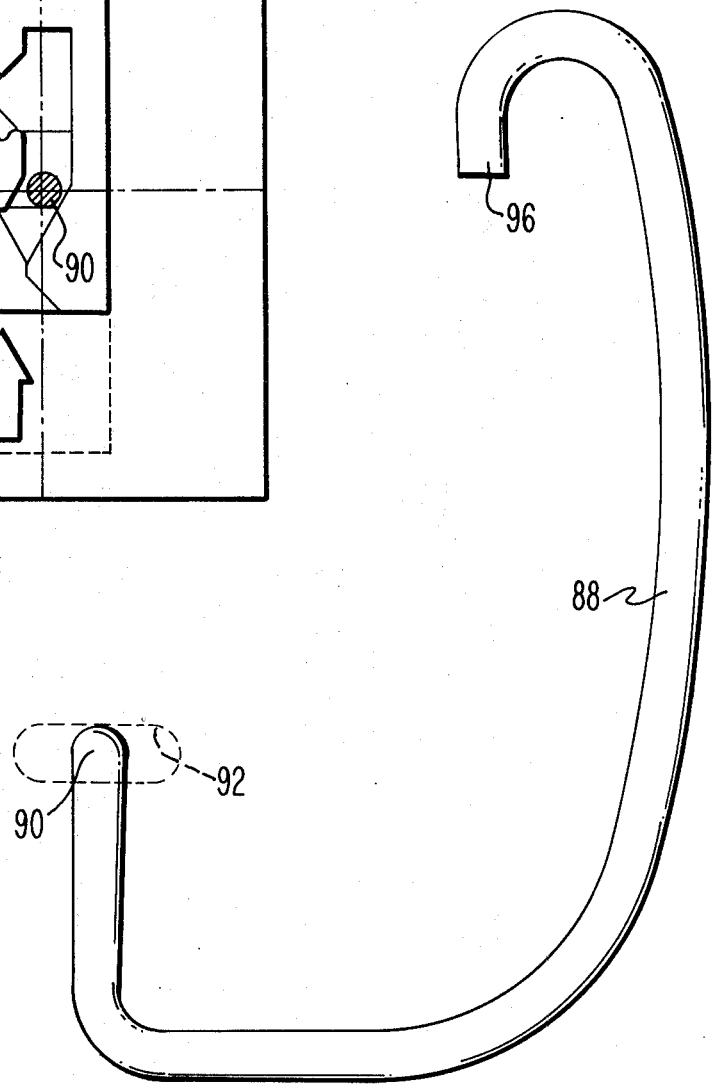
FIG. 12 is a view of the C-spring illustrating its characteristic configuration as incorporated in the present invention.

Reference is first directed to FIGS. 5 and 6 wherein there is shown (not to scale) a shift lock cam 20, in accordance with the present invention, disposed within the receptacle-receiver 16 and retained therein by the overhanging lip 18. A substantially C-shaped torsion spring 88 illustrated in greatly enlarged detail in FIG. 12, is utilized with cam 20 and key stem 12 to lock the key stem in the desired "up" or "down" position as will now be described.

Figure 15:
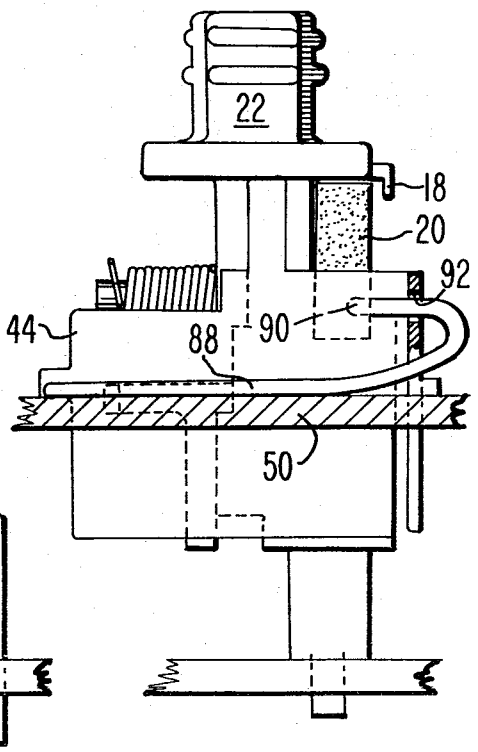
FIG. 15 is a side elevational view of the apparatus of FIG. 13.
Figure 14:
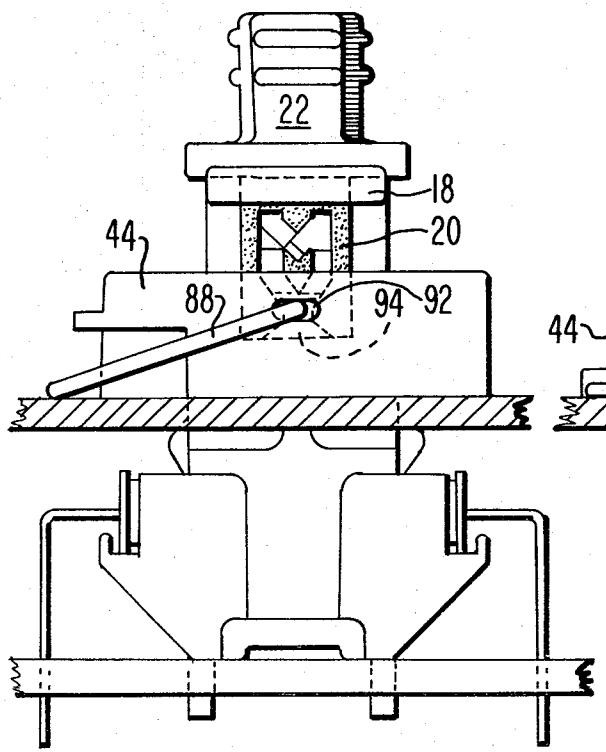
FIG. 14 is a front elevation view of the apparatus of FIG. 13.
Figure 13:
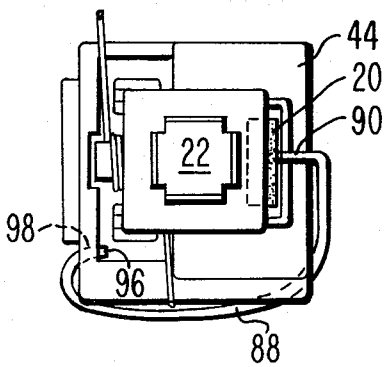
FIG. 13 is a top plan view of a key switch embodying the key switch cam lock actuation mechanism together with the C-spring.

Spring 88 which is characterized as a single turn torsion spring, is disposed substantially parallel to one side of the insert member, as seen in FIGS. 13, 14 and 15 with the right angled end 90 projecting into and through the oblate access opening or aperture 92 in insert 44, FIG. 14 so as to rest at the lower triangularly shaped open end 94 of cam member 20. The opposite curved end 96 of the torsion spring is captivated in aperture 98, FIG. 13 in the opposite side of the insert member 44. Vertical "up and down" movement of cam 20 is thus slightly resisted by the torsion spring 88.

Figure 7:
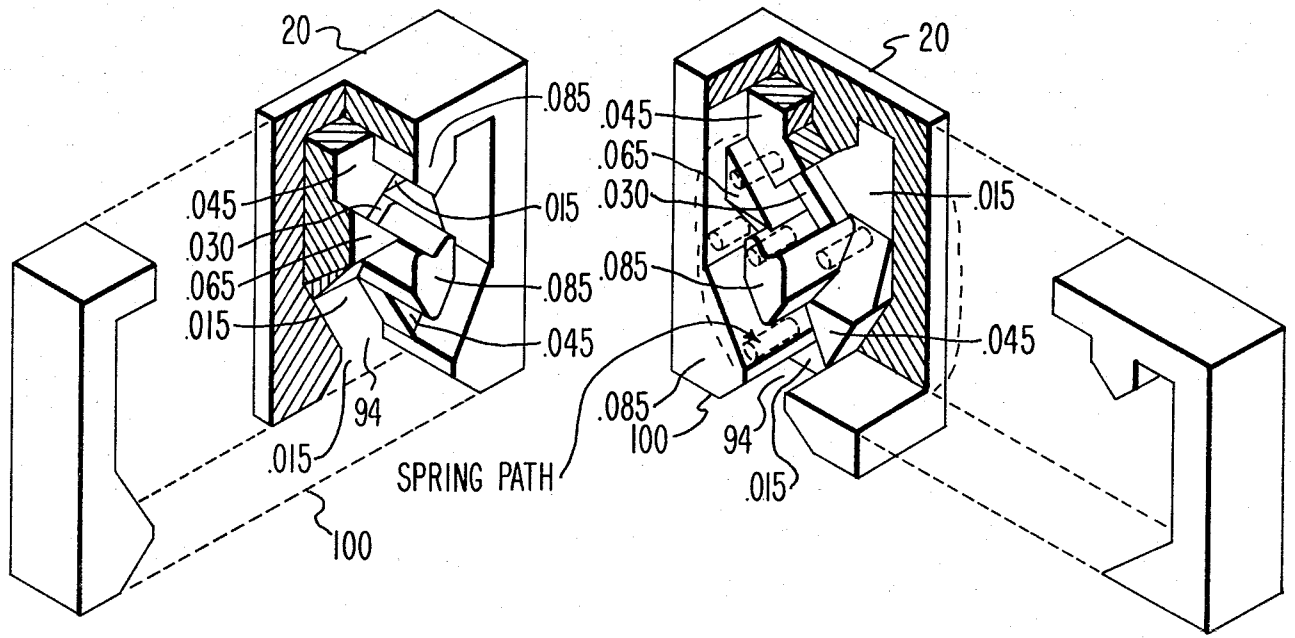
FIG. 7 is an exploded isometric view of one form of the shift lock cam actuation mechanism as the present invention.

Referring now to FIG. 7 it is seen that the irregular, internal shape of the various surfaces of the cam 20 as will be described hereinafter, provides automatic means for "locking" i.e. momentarily fixing or holding, the key stem 12 in a desired position-either "up or down".

Speaking in the vernaculer the various interconnected slanted or angled surfaces of cam 20 provide a "one way street" for the spring end 90 since the cam surfaces over which the spring end is adapted to move are stair step saw tooth-like. Thus, as will be seen hereinafter, the spring end 90 is constrained to follow a single pathway even though the key stem 12 is progressively, vertically depressed and released and cannot reverse the direction of movement.

Also, it is noted that the spring 88 does not move as such although the oblate hole or aperture 92 permits of a minor degree of lateral motion. However, as will become clear shortly the cam member 20 partakes of a slight side to side movement as a consequence of the up and down movement of the key stem 12.

As shown in FIG. 7 the decimal numbers represent the height of the various steps or inclined planes from the bottom edge 100 of the cam. For example, the first plane is 0.015 inches from this bottom edge.

Figure 8:
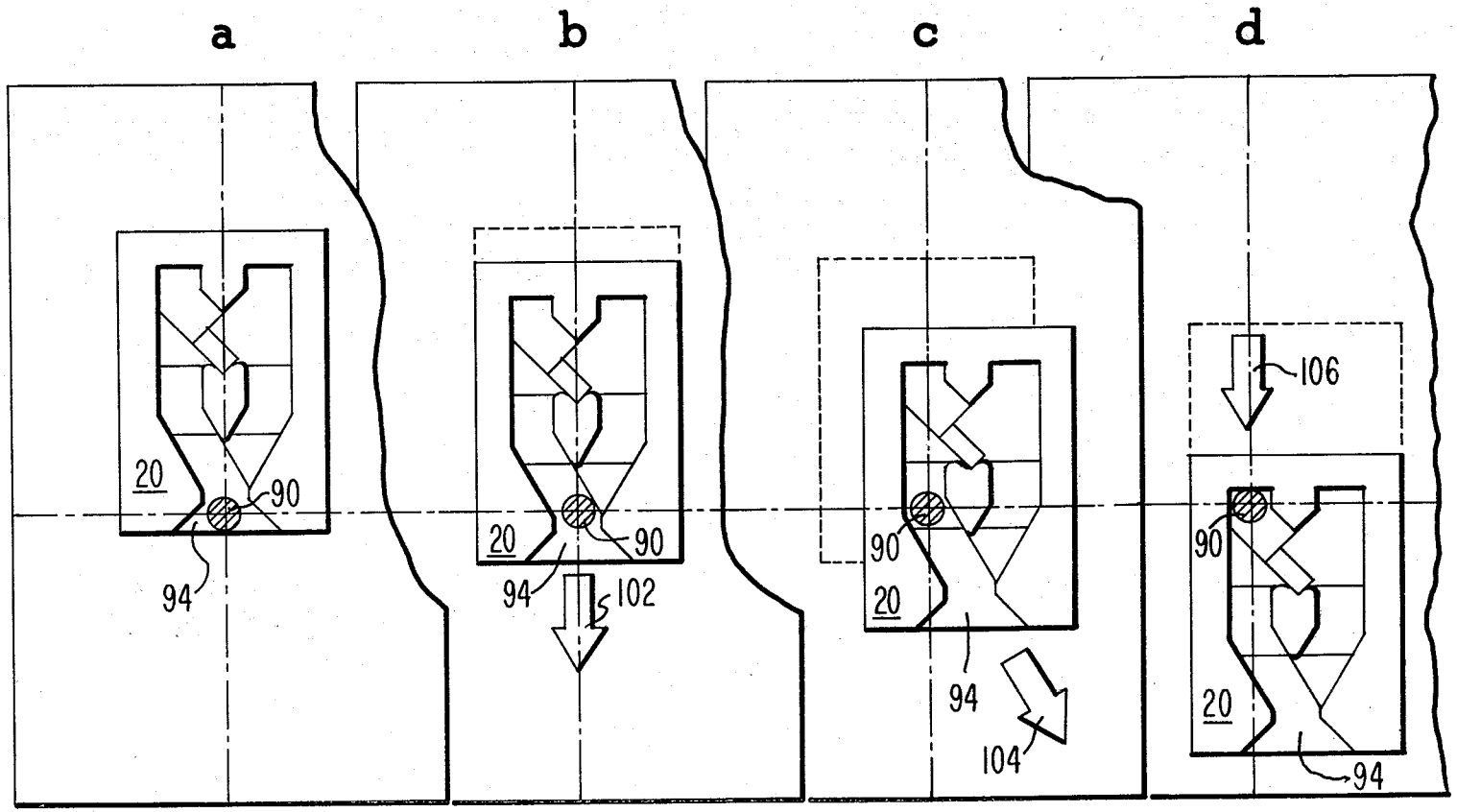
FIGS. 8*a* through 8*d* are a series of four front elevational views (not to scale) of the shift lock cam actuation mechanism as a key switch is initially depressed.

FIGS. 8*a* through 8*d* are characterized as stage one of the operation of the present invention. In FIG. 8*a* the key stem 12 is in the "up" or home position as indicated by the crossed vertical lines passing through the sectioned spring end 90. As the key stem is depressed the cam 20 moves downwardly as indicated by the heavy arrow 102 FIG. 8*b*, the spring end 90 moving up the 0.015 portion of the inclined area of the cam. Further depression of the key stem 12 FIG. 8*c* pushes the cam further down and to the right as indicated by the heavy arrow 104. In FIG. 8*d* the cam 20 has moved (arrow 106) to the bottom most position (from the dotted to the heavy line position) with the spring end 90 abutting the top left interior portion of the cam designated 0.045 in FIG. 7.

Figure 9:
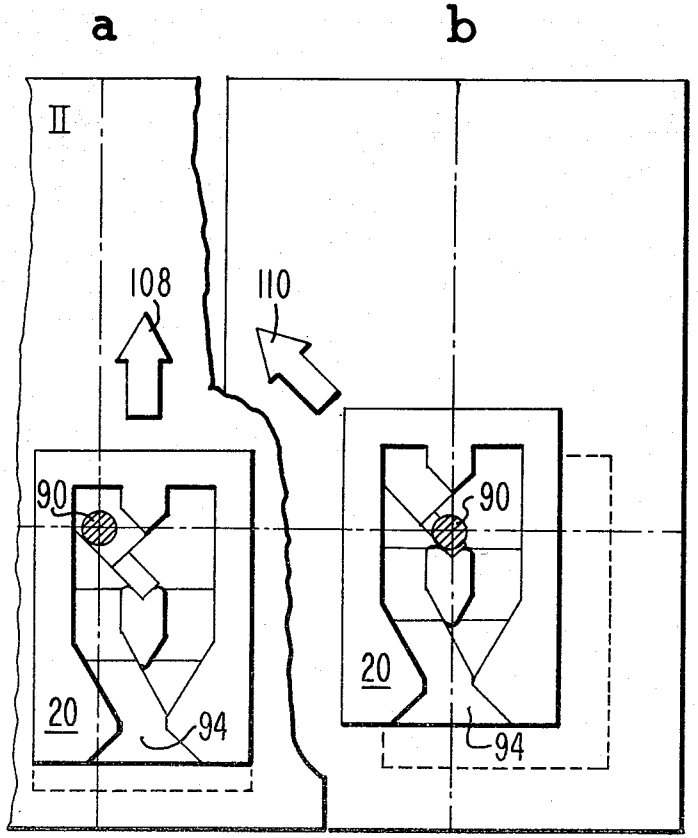
FIGS. 9*a* and 9*b* are a series of two views similar to the views of FIG. 8 but illustrating the C-spring in its first locked position.

In FIGS. 9*a* and 9*b* the second stage of the operation of the shift lock mechanism, the key is released by the operator. As the key is released the stem 12 starts its upward travel (arrow 108). The spring end 90 slides over the area 0.065 FIG. 7 whereupon the cam 20 is moved upwardly and to the left (arrow 110) causing the spring end 90 to bottom in the down "locked" position.

Figure 10:
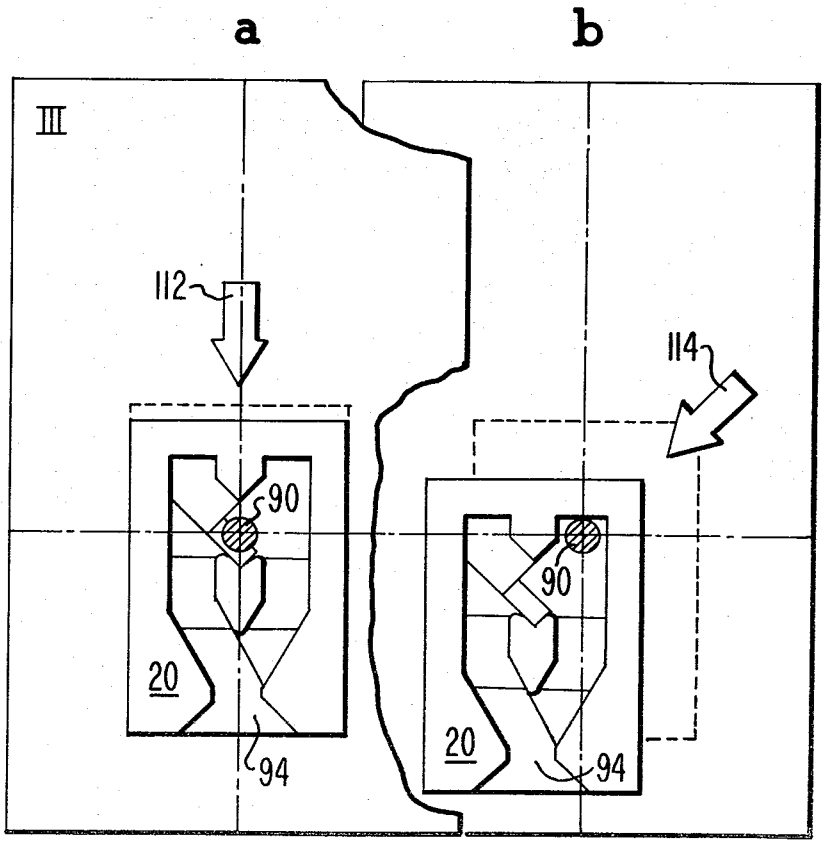
FIGS. 10*a* and 10*b* are a series of two views illustrating the second key depression and the movement of the shift lock cam relative to the stem.

FIGS. 10*a* and 10*b* can be characterized as stage three of the shift lock operation and is initiated by the depression of the key causing the stem 12 to carry the cam downwardly FIG. 10*a* (arrow 112) removing the spring end from the notch above the portion of the cam identified as 0.085 and causing the cam to move down and to the left (arrow 114) bringing the spring end 90 to the upper right corner of the cam.

Figure 11:
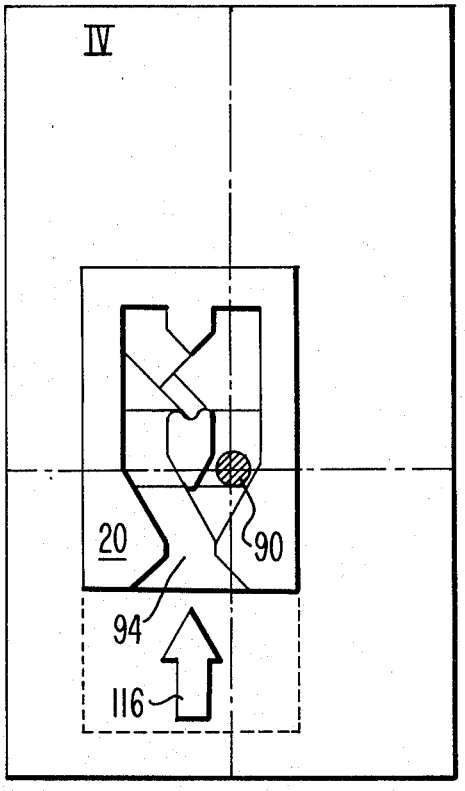
FIG. 11 is a view illustrating the cam in its return positioning movement to the initial or home position of FIG. 8*a;*

As the key is now released at stage four of the operation by the operator, FIG. 11, the upward movement of the key stem 12 (arrow 116) forces the spring end 90 to follow the outwardly, downwardly sloping sides of the cam surface 0.015 and 0.045 to bring the spring end 90 ultimately to its stage one position as shown in FIG. 8*a*.

There has thus been described a new, novel and heretofore unobvious shift lock actuation mechanism for use with those types of apparatus wherein it is necessary or desirable to lock the switching device in one or the other of two opposed positions or conditions. The present invention as illustrated and described provides a shift lock capability with a standard key stem configuration without the necessity of a special housing or support. The novel structural combination thus described eliminates coil springs and or pins for shift locking by substituting a C-shaped single turn torsion spring to achieve both functions. The C-spring thus becomes the index pin as it moves within the shift lock cam to position and to lock the key stem as desired. The shift lock cam is seen to partake of both an up and down movement as well as a degree of horizontal motion. The present structural arrangement is cheaper to fabricate since it requires fewer operating parts and is easier to assemble since the shift lock cam is automatically captivated once it is placed in its receptacle and the key stem is inserted within the insert member with which it is operably associated.

What is claimed is:

1. A shift lock mechanism for photo-optical switch apparatus comprising, an insert member including means for snap-in insertion of said member in a respective aperture in a keyboard array of apertures, a slidable shutter member including an aperture therein, said shutter member being vertically, slidably movable in said insert member effective in one position to block light from a light generator to a light receptor and in another position to permit light to pass unobstructed from said light generator to said light receptor, said shutter member further including an external, horizontally disposed, biasing member for biasing said shutter member vertically upwardly into a light blocking position within said insert member, an externally supported demountable, removable cam member slidably horizontally received on said shutter member in diametric opposition to said horizontally disposed biasing member and including means for demountably, receiving and guiding a cam follower member therein, and a cam follower member loosely slidably mounted on said insert member with one end inserted in said insert member and axially aligned with said horizontally disposed biasing member, the opposite end of said follower member engaging said demountable cam member effective in one position to lock said shutter member in a light passing position and in another position to block the light from said light generating member.

2. The invention in accordance with claim 1 wherein said shutter member further includes a horizontally disposed mounting post for mounting said biasing member so that the ends of the biasing member are in constant contact with the edges of said insert member.

3. The invention in accordance with claim 2 wherein said biasing means comprises a coiled torsion spring the ends of which are angled upwardly away from the mounting post.

4. The invention in accordance with claim 1 wherein said shutter member further includes a horizontal lip arranged along an edge opposite to said biasing member for loosely retaining said demountable cam member while permitting said cam member to move from side to side as the shutter member moves the cam member.

5. The invention in accordance with claim 1 wherein said shutter member includes a light passing aperture therein and wherein said aperture is axially displaced relative to the vertical axis of said shutter member.

6. The invention in accordance with claim 1 further including a coupler support member operably associated with said insert member and said shutter member and a printed circuit board with said coupler member inserted into said printed circuit board and including snap-in attachment means for a light generating and a light receptor oppositely disposed with respect to said shutter member.

7. The invention in accordance with claim 1 wherein said shutter member further comprises a substantially t-shaped member the upper terminal portion of which includes means for snap-in mounting of an indicia key top and wherein the lower terminal portion of said t-shaped member is disposed at right angles to the upper portion and includes oppositely disposed integral angular projections forming stop members for entrapping said shutter and preventing accidental dislodgement thereof from said insert member.

* * * * *